US007306192B2

(12) United States Patent
Sopp

(10) Patent No.: US 7,306,192 B2
(45) Date of Patent: Dec. 11, 2007

(54) HEIGHT-ADJUSTABLE COLUMN

(75) Inventor: Dirk Peter Sopp, Bomich (DE)

(73) Assignee: Stabilus GmbH, Koblenz (DE)

( * ) Notice: Subject to any disclaimer, the term of this patent is extended or adjusted under 35 U.S.C. 154(b) by 0 days.

(21) Appl. No.: 11/472,655

(22) Filed: Jun. 22, 2006

(65) Prior Publication Data

US 2007/0215764 A1 Sep. 20, 2007

(30) Foreign Application Priority Data

Mar. 14, 2006 (DE) ..... 10 2006 011 491

(51) Int. Cl.
*F16M 11/00* (2006.01)

(52) U.S. Cl. ..... 248/404; 248/157; 248/631; 297/423.38

(58) Field of Classification Search ..... 248/158, 248/160, 162.1, 404, 410, 157, 631, 161; 297/423.38, 344.19
See application file for complete search history.

(56) References Cited

U.S. PATENT DOCUMENTS 4,693,442 A * 9/1987 Sills ..... 248/406.2
4,940,202 A * 7/1990 Hosan et al. ..... 248/162.1
5,377,942 A * 1/1995 Knopp et al. ..... 248/161
5,443,573 A * 8/1995 Thiele et al. ..... 267/64.12
5,531,413 A * 7/1996 Wolf et al. ..... 248/188.2
5,992,815 A * 11/1999 Metzdorf et al. ..... 248/631
6,276,756 B1 * 8/2001 Cho et al. ..... 297/344.19
6,402,102 B1 * 6/2002 Sendfeld et al. ..... 248/161
7,134,634 B2 * 11/2006 Jeon et al. ..... 248/161
2004/0041063 A1 * 3/2004 Enders et al. ..... 248/161

* cited by examiner

*Primary Examiner*—Ramon O Ramirez
(74) *Attorney, Agent, or Firm*—Cohen Pontani Lieberman & Pavane LLP

(57) ABSTRACT

A height-adjustable chair column includes a vertical post axially extending along a longitudinal axis, a bottom plate, a guide cylinder bushing permanently inserted into the upper end area of the vertical post, and a guide tube inserted in the guide cylinder bushing so that it is guided with freedom of axial movement and secured against rotation in the guide cylinder bushing. Further, the chair column includes a lockable gas spring assembly with a pressure cylinder, which is installed coaxially in the guide tube such that it is secured against axial displacement relative to the guide tube and it is free to rotate about the longitudinal axis, and with a piston installed in the pressure cylinder with freedom of sliding axially. The piston is connected to a piston rod which is fastened to the bottom plate and supported there with freedom of rotation about the longitudinal axis. Moreover, a height-adjustable foot rest is attached to the upper end region of the guide tube.

17 Claims, 3 Drawing Sheets

HEIGHT-ADJUSTABLE COLUMN

BACKGROUND OF THE INVENTION

The invention pertains to a height-adjustable chair column with a vertical post, a height-adjustable foot rest, and a lockable gas spring assembly, which is installed coaxially in the vertical post with freedom to slide up and down and to rotate about its longitudinal axis.

In these types of chair columns, it is known that the foot rest can be fastened at the desired height to a clip encircling the vertical post. This means that, every time the height of the chair column is adjusted, it is also necessary to make a separate height adjustment to the foot rest. This is inconvenient.

SUMMARY OF THE INVENTION

It is an object of the invention to create a height-adjustable chair column in which the height of both the chair column and the high load-bearing foot rest can be adjusted in a single step.

In a preferred embodiment of the invention, the height-adjustable chair column comprises a vertical post axially extending along a longitudinal axis, the vertical post having a first upper end area and a second lower end area; a bottom plate mounted in the second lower end area of the vertical post; a guide cylinder bushing permanently inserted into the first upper end area of the vertical post; a guide tube inserted in the guide cylinder bushing so as to be guided with freedom of axial movement, while being secured against rotation in the guide cylinder bushing, the guide tube having an upper end region projecting out from the guide cylinder bushing; a lockable gas spring assembly including a pressure cylinder having a first closed end portion projecting out from the first upper end area of the vertical post, and a second end portion arranged within the vertical post, the pressure cylinder being installed coaxially in the guide tube so as to be secured against axial displacement relative to the guide tube, while being free to rotate about the longitudinal axis, and a piston installed in the pressure cylinder with freedom of sliding axially, the piston being connected to a piston rod which passes out in a sealed manner through the second end of the pressure cylinder, wherein the piston rod comprises a lower end which is fastened to the bottom plate and supported there with freedom of rotation about the longitudinal axis; and a height-adjustable foot rest which is attached to the upper end region of the guide tube. The arrangement of the gas spring assembly in the guide tube and the ability of the guide tube to slide in the guide cylinder bushing of the vertical post ensures a high load-bearing capacity, whereas the mounting of the foot rest on the guide tube ensures that, when the gas spring assembly moves, the foot rest is adjusted at the same time.

One or more radially inward projecting guide blocks can be permanently attached to a first upper end area of the vertical post. These blocks engage in corresponding axial guide grooves in the radially surrounding lateral surface of the guide tube.

The number of parts can be reduced and the simplicity and ease of installation can be increased by providing the guide blocks on a guide ring, which can be tightly inserted into the first upper end area of the vertical post.

An especially high load-bearing capacity is obtained by making the guide tube out of a metal material, especially steel.

To easily rotate the gas spring assembly about the longitudinal axis, one or more guide bushings can be permanently installed in the guide tube. The pressure cylinder is then installed in these guide bushings so that it is free to rotate about the longitudinal axis.

The guide bushings are preferably made of a material with low frictional resistance such as a plastic suitable for bearing applications.

To secure the gas spring assembly axially to the guide tube in a way which is both simple and compact, at the lower end portion of the pressure cylinder, i.e., at the end at which the piston rod emerges, a radially projecting collar can be arranged. This collar is gripped on both axial sides by first and second stops on the guide tube and is able to rotate relative to the guide tube about the longitudinal axis between the stops.

The collar can be attached easily yet permanently by providing the collar on a cylindrical insert, which is inserted tightly into the pressure cylinder of the gas spring assembly. The insert is then permanently connected to the pressure cylinder, especially by dimpling.

Assembly can also be made easier by providing the second stop axially facing the guide tube on a sleeve, which can be permanently inserted into the guide tube.

To reduce the number of components, the sleeve can be one of the guide bushings and thus serve a double function.

One of the end surfaces of the guide bushing can also serve a double function by forming the first stop on the guide tube side, i.e., the side against which the collar rests axially.

To strengthen the support, the collar is preferably supported axially against the second stop, which is facing the guide tube, by a support washer. The load can be distributed uniformly around the entire circumference by providing the axial stop facing the guide tube in the form of a closed or split stop ring.

To reduce the number of components and thus to facilitate assembly, the guide bushing and the second axial stop facing the guide tube can be designed as a single part.

Assembly is also facilitated by bringing the collar or the support washer into axial contact with the second stop by way of a lock washer.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

An exemplary embodiment of the invention is illustrated in the drawings and described in greater detail below.

DETAILED DESCRIPTION OF THE PRESENTLY PREFERRED EMBODIMENTS

Figure 1:
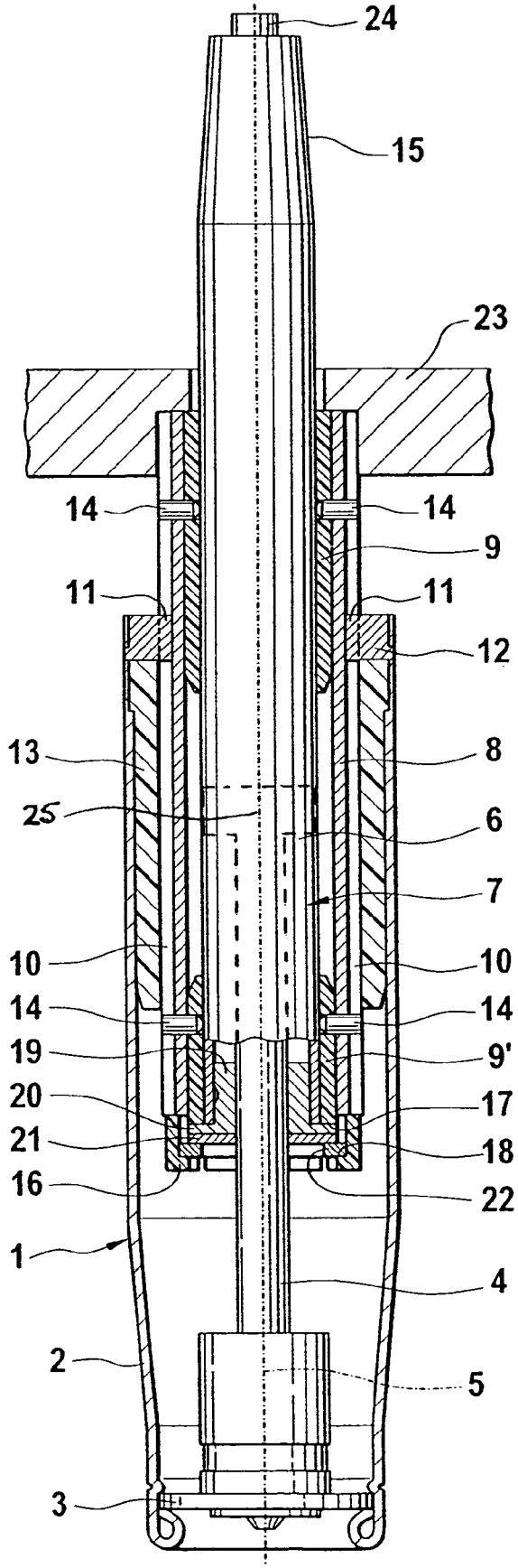
FIG. 1 is a cross sectional view of a chair column.
Figure 2:
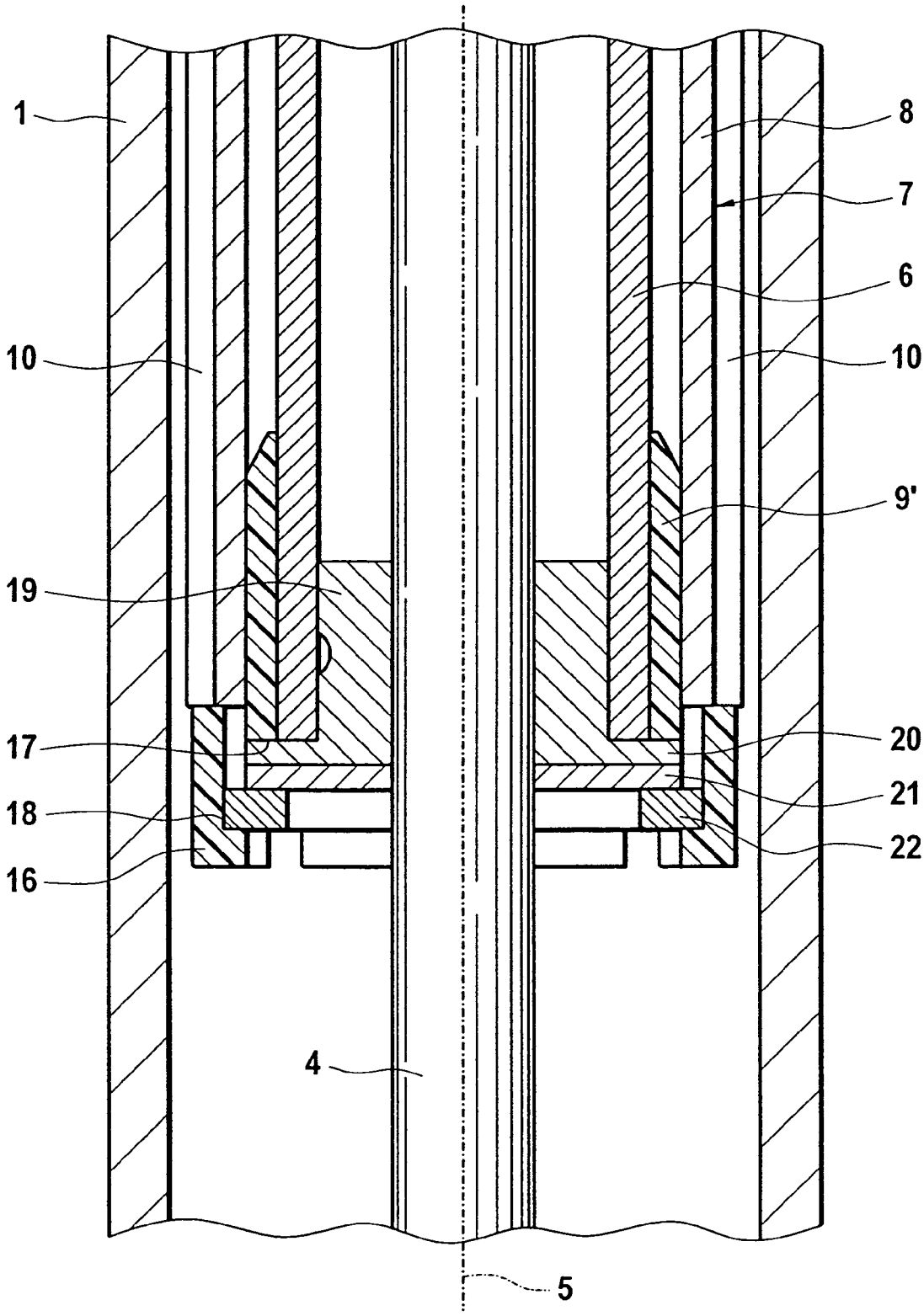
FIG. 2 is an enlarged view of a part of the chair column of FIG. 1.

The chair column shown in FIGS. 1 and 2 has a vertical post 1, which is designed with a cone 2 at the bottom for the attachment of a chair base (not shown).

A bottom plate 3 is mounted in the bottom end of the vertical post 1. The free end of a piston rod 4 is attached to this plate 3 and is supported there so that it is free to rotate about its longitudinal axis 5.

The piston rod 4 extends into the pressure cylinder 6 of a lockable gas spring 7, which is installed coaxially in the vertical post 1. The end of the piston rod 4 projecting into the pressure cylinder 6 is connected to a piston 25, which slides back and forth in the pressure cylinder 6.

Figure 3:
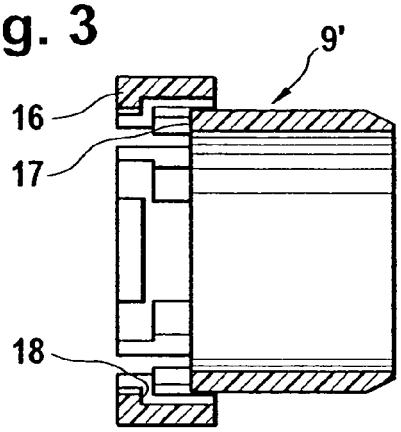
FIG. 3 is a cross-sectional view of a guide bushing of the chair column of FIG. 1.
Figure 4:
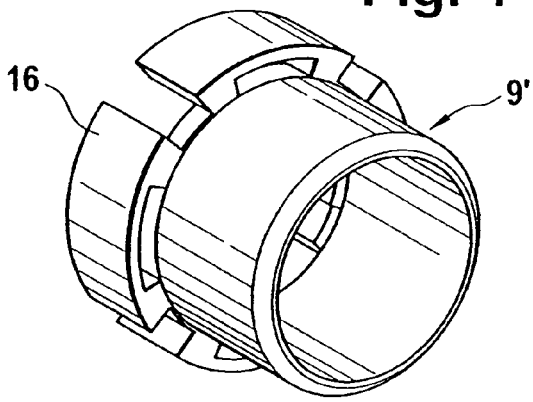
FIG. 4 is a perspective view of the guide bushing of FIG. 3.

The cylindrical lateral surface of the pressure cylinder 6 is supported inside a guide tube 8 so that the pressure cylinder 6 can rotate inside the guide tube 8. Guide bushings 9 and 9' (FIGS. 3 and 4) are permanently attached to the end areas of the guide tube 8 to guide the rotation of the pressure cylinder 6.

Figure 7:
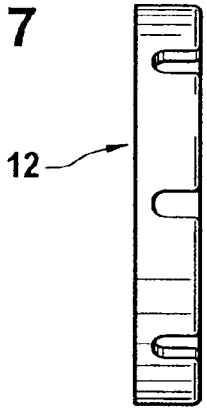
FIG. 7 is a side view of a guide ring for the chair column of FIG. 1.
Figure 8:
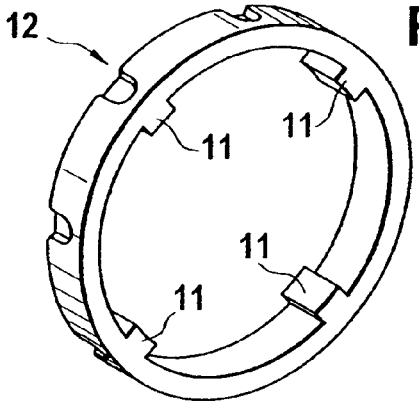
FIG. 8 is a perspective view of the guide ring of FIG. 7.

The upper end of the guide tube 8 projects from the vertical post 1, and its lateral, circumferential surface has axial guide grooves 10, uniformly distributed around the circumference, into which radially inward directed guide blocks 11, located on a guide ring 12 (FIGS. 7 and 8), project.

The guide ring 12 is permanently inserted into the upper end area of the vertical post 1.

Axially adjoining the guide ring, a guide cylinder bushing 13 is firmly inserted into the vertical post 1. The guide tube 8 is guided with freedom to slide back and forth inside this bushing 13, but it cannot rotate due to the engagement of guide blocks 11 and guide grooves 10.

The guide bushings 9 and 9' are connected to the guide tube 8 by spring dowel pins 14. These pins 14 are inserted permanently into bores, which extend through the guide tube 8 and the guide bushings 9, 9' in a direction transverse to the longitudinal axis 5.

The upper end of the pressure cylinder 6 projects out of the guide tube 8 and has a cone 15, to which a seat (not shown) of the chair can be attached.

The end surface of an actuating plunger 24 projects out from the upper end of the pressure cylinder 6. This plunger 24 is used to release the locking of the gas spring 7 and thus to allow the height of the chair column to be adjusted.

The lower guide bushing 9' projects slightly from the guide tube 8 and carries as an integral part a split stop ring 16, which is located a certain distance away from the lower end surface of the guide bushing 9'. This stop ring 16 is concentric to the longitudinal axis 5 and has an inside diameter which is slightly larger than the outside diameter of the pressure cylinder 6. The lower end surface of the guide bushing 9' forms a first stop 17, and the side of the stop ring 16 opposite the first stop 17 and a certain distance away from it forms a second stop 18.

Figure 5:
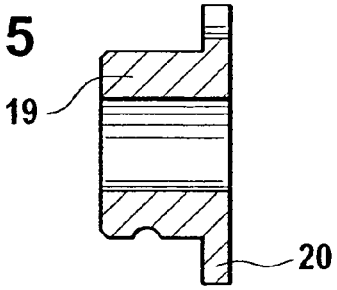
FIG. 5 is a cross-sectional view of an insert for the chair column of FIG. 1.
Figure 6:
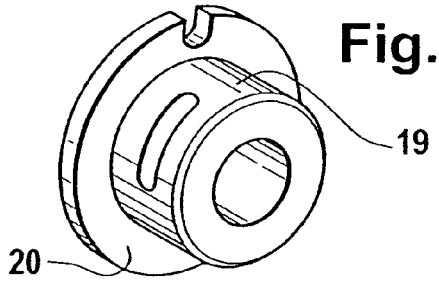
FIG. 6 is a perspective view of the insert of FIG. 5.

A cylindrical insert 19 (FIGS. 5 and 6) is installed in the lower end of the pressure cylinder 6 and is permanently connected to the pressure cylinder 6, for example by a catch or dimpling on at least one of the two opposing surfaces of the cylindrical insert 19 and the pressure cylinder 6. The piston rod 4 passes through a cylindrical opening in the insert 19.

A flange-like, radially projecting, circumferential collar 20 is formed as an integral part of the insert 19, namely, on the end of the insert 19 which projects from the pressure cylinder 6. One side of this collar 20 rests axially against the first stop 17.

Figure 9:
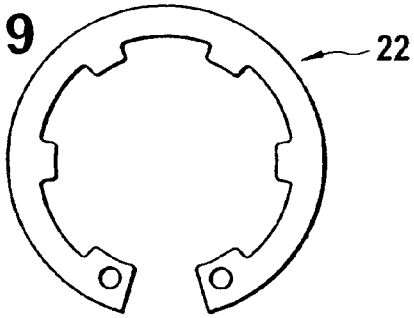
FIG. 9 is a top view of a lock washer for the chair column of FIG. 1.
Figure 10:
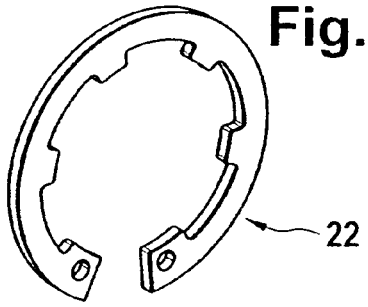
FIG. 10 is a perspective view of the lock washer of FIG. 9.

The collar 20 is also supported axially against the second stop 18 by way of a support washer 21, which rests against the side of the insert 19 and of the collar 20 facing away from the guide tube 8, and by way of a lock washer 22 (FIGS. 9 and 10), which is inserted between the support washer 21 and the second stop 18. The piston rod 4 also passes through the center opening in the support washer 21.

Thus the gas spring 7 is secured against axial displacement relative to the guide tube 8.

Nevertheless, the gas spring 7 is still free to rotate about the longitudinal axis 5 relative to the guide tube 8.

A radially oriented foot rest 23 with a stepped bore is mounted on the end of the guide tube 8 which projects from the vertical post 1. The foot rest 23 can be designed as a foot ring.

Because the foot rest 23 is attached to the guide tube 8, the height of the foot rest 23 will also be adjusted when the height of the chair column is changed.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A height-adjustable chair column comprising a vertical post having a longitudinal axis, a first upper end area, and a second lower end area;

a bottom plate mounted in the second lower end area of the vertical post;

a guide cylinder bushing permanently inserted into the first upper end area of the vertical post;

a guide tube inserted in the guide cylinder bushing so as to be guided with freedom of axial movement and secured against rotation in the guide cylinder bushing, the guide tube having an upper end region projecting out from the guide cylinder bushing;

a lockable gas spring assembly including:

a pressure cylinder having a first closed end portion projecting out from the first upper end area of the vertical post, and a second end portion arranged within the vertical post, the pressure cylinder being installed coaxially in the guide tube so as to be secured against axial displacement relative to the guide tube, while being free to rotate about the longitudinal axis relative to said guide tube, and a piston axially movably arranged in the pressure cylinder, the piston being connected to a piston rod sealingly extending through the second end of the pressure cylinder, wherein the piston rod comprises a lower end which is fastened to the bottom plate and supported there with freedom of rotation about the longitudinal axis; and a height-adjustable foot rest which is attached to the upper end region of the guide tube.

2. The chair column of claim 1, wherein one or more radially inward directed guide blocks are permanently attached to the first upper end area of the vertical post, which guide blocks engage in corresponding axial guide grooves formed in a circumferential lateral surface of the guide tube.

3. The chair column of claim 2, wherein the guide blocks are located on a guide ring inserted into the first upper end area of the vertical post.

4. The chair column of claim 1, wherein the guide tube is made of a metal material.

5. The chair column of claim 1, wherein one or more guide bushings are permanently mounted in the guide tube, the pressure cylinder being mounted in the guide bushings with freedom to rotate about the longitudinal axis.

6. The chair column of claim 1, wherein the gas spring assembly has a radially projecting collar in the area of the second end portion of the pressure cylinder, the collar being gripped on both axial sides by a first stop and a second stop of the guide tube, but being free to rotate relative to the guide tube about the longitudinal axis between the first and second stops.

7. The chair column of claim 6, wherein the collar is located on a cylindrical insert, which is tightly inserted into the pressure cylinder of the gas spring assembly.

8. The chair column of claim 7, wherein the cylindrical insert is permanently connected to the pressure cylinder by dimpling.

9. The chair column of claim 6, wherein the second stop axially facing the guide tube is arranged on a sleeve tightly inserted into the guide tube.

10. The chair column of claim 9, wherein the sleeve is a guide bushing, the pressure cylinder being mounted in the guide bushing with freedom to rotate about the longitudinal axis.

11. The chair column of claim 9, wherein the second stop is a closed or a split stop ring.

12. The chair column of claim 11, wherein the sleeve and the second stop are formed as a single part.

13. The chair column of claim 6, wherein the collar is supported axially against the second stop, which is facing the guide tube, by way of a support washer.

14. The chair column of claim 13, wherein the second stop faces the guide tube, a lock washer being arranged between the support washer and the second stop such that the collar is held against the second stop by way of the support washer and the lock washer.

15. The chair column of claim 6, wherein the second stop is a closed or a split stop ring.

16. The chair column of claim 6, wherein the second stop faces the guide tube, a lock washer being arranged between the collar and the second stop such that the collar is held against the second stop by way of the lock washer.

17. The chair column of claim 6, wherein the first stop is formed by a bottom surface of a guide bushing permanently mounted in the guide tube.

* * * * *